US007840155B2

(12) United States Patent
Miyabe et al.

(10) Patent No.: US 7,840,155 B2
(45) **Date of Patent: *Nov. 23, 2010**

(54) DEVELOPING DEVICE AND IMAGE FORMING APPARATUS

(75) Inventors: Shigeo Miyabe, Numazu (JP); Masaaki Sato, Suntoh-gun (JP); Osamu Anan, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/423,602

(22) Filed: Apr. 14, 2009

(65) Prior Publication Data

US 2009/0202277 A1 Aug. 13, 2009

Related U.S. Application Data

(63) Continuation of application No. 11/553,865, filed on Oct. 27, 2006, now Pat. No. 7,580,659.

(30) Foreign Application Priority Data

Oct. 31, 2005 (JP) ..... 2005-317209

(51) Int. Cl.
*G03G 21/20* (2006.01)
*G03G 15/08* (2006.01)

(52) U.S. Cl. ..... 399/91; 399/285

(58) Field of Classification Search ..... 399/91, 399/285

See application file for complete search history.

(56) References Cited

U.S. PATENT DOCUMENTS

2003/0059228 A1* 3/2003 Tatsumi ..... 399/103
2005/0008401 A1* 1/2005 Kawamura et al. ..... 399/265

* cited by examiner

*Primary Examiner*—David M Gray
*Assistant Examiner*—Andrew V Do
(74) *Attorney, Agent, or Firm*—Canon USA Inc IP Div

(57) ABSTRACT

A developing device facing an image carrier and including a developer carrier, a developer flying control member, and a development-noise control member. The developing device develops an electrostatic image formed on the image carrier by causing the developer to fly from the developer carrier to the image carrier upon an application of an alternating-current bias to the developer carrier. Noise produced by the development-noise control member vibrated by an oscillating electric field of the alternating-current bias is smaller than a noise produced by the developer flying control member vibrated by the oscillating electric field.

12 Claims, 13 Drawing Sheets

DEVELOPING DEVICE AND IMAGE FORMING APPARATUS

CROSS-REFERENCE TO RELATED APPLICATIONS

This application is a continuation of U.S. patent application Ser. No. 11/553,865 filed Oct. 27, 2006, which claims the benefit of Japanese Application No. 2005-317209 filed Oct. 31, 2005, all of which are hereby incorporated by reference herein in their entirety.

BACKGROUND OF THE INVENTION

1. Field of the Invention

The present invention relates to a developing device for use in an image forming apparatus and to an image forming apparatus including the developing device.

2. Description of the Related Art

An electrophotographic or electrostatic recording image forming apparatus, such as a copier, a printer, or other apparatuses electrostatically charges and then exposes an electrophotographic photosensitive member (photosensitive member) serving as an image carrier, thereby forming an electrostatic image (latent image) thereon. By developing the latent image by the use of toner being a developer, the apparatus forms toner images on the image carrier. The toner image is transferred to a transfer material (recording medium), such as a recording paper, a transparency, or other materials, directly or after being temporarily transferred to an intermediate transfer material. By fixing the toner image by the use of heat, pressure, and/or other elements, the apparatus can generate a recording image.

The photosensitive member and at least one of a charging unit, a developing unit, and a cleaning unit, which serve as a process unit acting on the photosensitive member, can be integrally combined into a cartridge so as to constitute a process cartridge attachable to and removable from a main body of the image forming apparatus. Alternatively, the developing unit can be singularly formed as a cartridge attachable to and removable from the main body. Such a cartridge system further enhances operability, so a user can easily perform maintenance of the process unit. Therefore, the cartridge system is widely used in electrophotographic image forming apparatuses.

One example of systems for developing a latent image on an image carrier is a system that performs development by applying an alternating electric field (oscillating electric field) between the image carrier and a developer carrier included in the developing device, the image carrier and the developer carrier being not in contact with each other. For this system, development is performed by attaching a developer flying/dispersed from the developer carrier to an electrostatic latent image formed on the image carrier.

In the case where the developer is dispersed from the developer carrier to the image carrier, even when the latent image to have consistent density has been formed on the image carrier to which the developer is to move, only the trailing end of an image can have a higher density because a larger amount of the developer is attached to the trailing end of the latent image. The image defects are called "sweep-together phenomenon." The sweep-together phenomenon is described below with reference to FIG. 16. FIG. 16 is a model diagram of a cylindrical photosensitive member (photosensitive drum) 101 serving as the image carrier and a development roller 2 serving as the developer carrier viewed from the longitudinal direction.

Sweep-together phenomena are phenomena in which a large amount of toner is gathered at the trailing end of an image in the direction of movement of the surface of the photosensitive drum 101, as indicated with a reference numeral H in FIG. 16. The toner image like this causes an image defect of inconsistencies in density in that one area is denser than the other areas.

As illustrated in FIG. 16, when an AC bias is applied to the development roller 2, a barrel-shaped electric field D occurs between the photosensitive drum 101 and the development roller 2. Toner T attached to the surface of the development roller 2 reciprocates between the photosensitive drum 101 and the development roller 2 along electric lines of force formed by an electric field. If the barrel-shaped electric field D described above is formed, the toner T moves outwardly from a closest point S of contact between the photosensitive drum 101 and the development roller 2. In other wards, when an AC bias is applied to the development roller 2, the toner T1 within a developing area G has a velocity component that always moves in a direction outward from the developing area G.

A case is described below in which the photosensitive drum 101 and the development roller 2 are rotating in the direction of the arrows in FIG. 16, and a latent image is being formed on the photosensitive drum 101, that is, an operation during an actual development is described. In FIG. 16, a region with a potential of −100 V on the photosensitive drum 101 is a latent-image part and an area on which a toner image is to be formed. A region with a potential of −500 V on the photosensitive drum 101 is a reference-potential part of the photosensitive drum 101 and an area on which the toner image is not to be formed.

When the latent-image part reaches the inside of the developing area G, the toner T on the development roller 2 is attaching to the latent-image part. However, since the flying toner T1 has a velocity component that moves in the direction outward from the developing area G, as described above, the toner T1 moves upstream of the latent-image part. At the border between the region having a potential of −100 V and the region having a potential of −500 V on the photosensitive drum 101, an electric field from the region having a potential of −500 V to the region having a potential of −100 V occurs. As a result, the toner T1 that has moved upstream of the latent-image part stops at this border. The amount of toner at the trailing end of the latent-image part is larger than that at the leading end and the central portion, so that the region H where toner is swept together (swept-together image H) is formed.

A method for reducing a sweep-together phenomenon by the provision of a plate member between an image carrier and a developer carrier is disclosed in Japanese Patent Laid-Open No. 8-022185.

The provision of the plate member between the image carrier and the developer carrier for reducing a sweep-together phenomenon requires the leading end of the plate member to be located within an AC electric field. This may cause the plate member to resonate with the AC electric field and thus increase the vibration of the plate member, so that an unpleasant high-frequency noise (hereinafter referred to as "AC noise" or "development noise") may be produced.

One approach to this problem is to slightly increase the thickness of the plate member or make a slit in the base thereof to avoid resonance and to lower AC noise relating to an AC bias having a predetermined frequency.

However, the coincidence between the natural frequency of the plate member and the frequency of the AC bias may cause resonance of the plate member and produce noise. In addition, in an image forming apparatus, the frequency of the AC bias applied to the developer carrier may be changed. For example, according to the temperature and/or humidity of the inside of the image forming apparatus, the frequency of the AC bias applied to the developer carrier may be changed. In this case, the plate member is more apt to resonate, compared with a case in which the frequency is not changed.

There is no consideration on efficient reduction in the AC noise in the case where the frequency of the AC bias applied to the developer carrier is changed.

SUMMARY OF THE INVENTION

The present invention is directed to a developing device and an image forming apparatus that are capable of efficiently reducing noise produced by the application of an alternating-current bias applied to a developer carrier. The present invention is also directed to a developing device and an image forming apparatus that are capable of efficiently reducing noise produced by the application of an alternating-current bias applied to a developer carrier when the frequency of the alternating-current bias is changed.

According to a first aspect of the present invention, a developing device for developing an electrostatic image formed on an image carrier with developer includes a developer carrier configured to carry and convey the developer. The device also includes a developer flying regulation member including a first end disposed between the image carrier and the developer carrier and being configured to regulate an area where the developer flies, and a development-noise regulation member covering the developer flying regulation member. The developing device develops an electrostatic image formed on the image carrier by causing the developer to fly from the developer carrier to the image carrier upon an application of an alternating-current bias to the developer carrier. In the developing device, noise produced by the development-noise regulation member vibrated by an oscillating electric field of the alternating-current bias is smaller than a noise produced by the developer flying regulation member vibrated by the oscillating electric field.

According to a second aspect of the present invention, a process cartridge includes the developing device and the image carrier.

According to a third aspect of the present invention, a developing device includes a developer carrier configured to carry and convey a developer, the developer carrier, to which an alternating-current bias is applied, developing a electrostatic image formed on a image carrier with the developer, the developer carrier being disposed so as to face the image carrier, a development frame configured to support the developer carrier, and a developer flying regulation member including a first end supported by the development frame and a second end disposed within a developing area between the developer carrier and the image carrier, and a development-noise regulation member including a third end supported by the development frame and a fourth end being in contact with the image carrier, the second end being located upstream of the second end of the developer flying regulation member and downstream of a position on the image carrier where the electrostatic image is formed in a direction of movement of a surface of the image carrier, the development-noise regulation member having a natural frequency being smaller than a frequency of an alternating-current bias.

According to a fourth aspect of the present invention, an image forming apparatus includes an image carrier on which an electrostatic image is formed, the developing device described above, and a bias application unit configured to apply an alternating-current bias for the development to the developer carrier.

Further features of the present invention will become apparent from the following description of exemplary embodiments with reference to the attached drawings.

DESCRIPTION OF THE EMBODIMENTS

Exemplary embodiments of a developing device and an image forming apparatus are described in detail with reference to the accompanying drawings.

First Exemplary Embodiment

[General Structure and Operation of Image Forming Apparatus]

Figure 1:
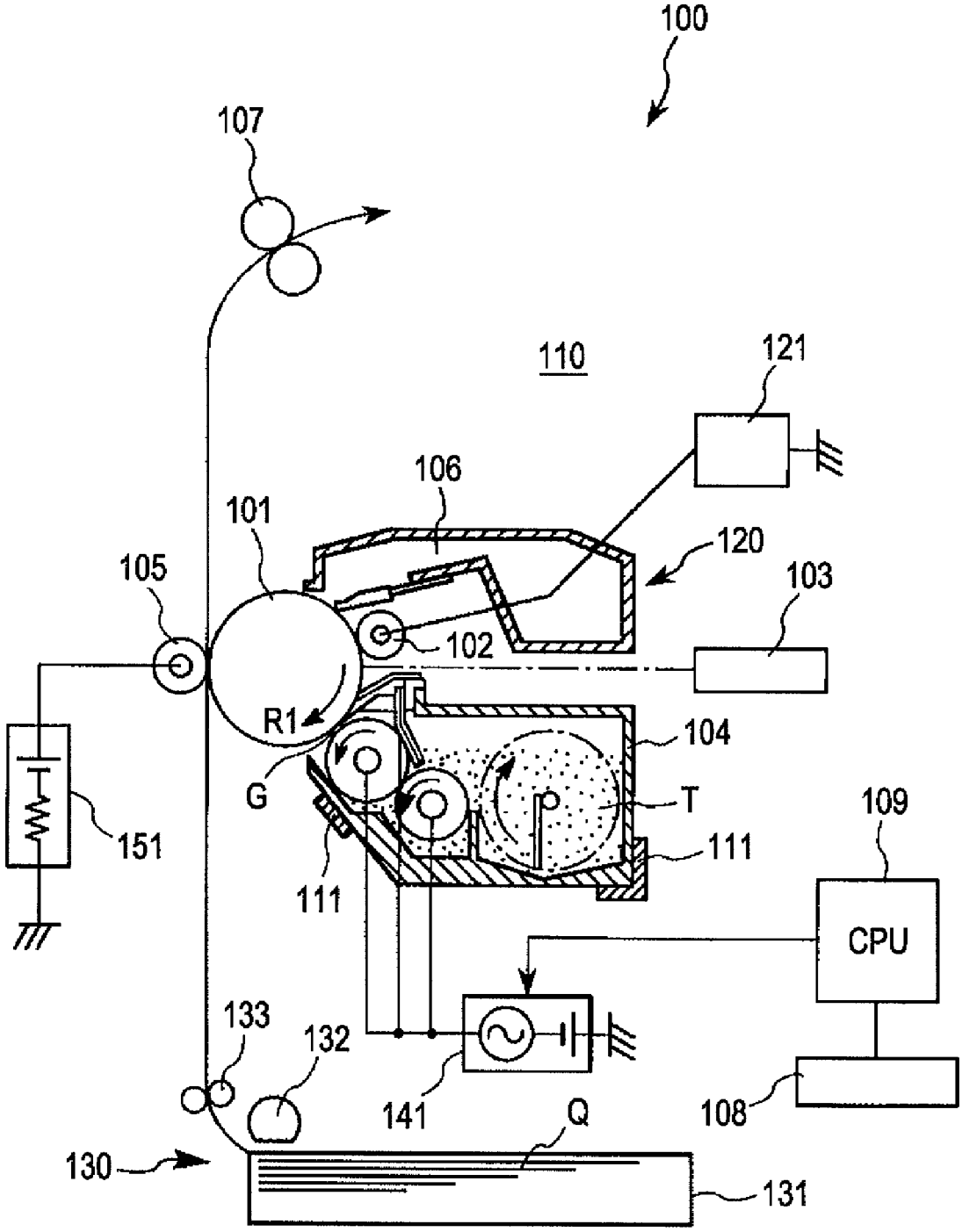
FIG. 1 is a schematic cross-sectional view of an image forming apparatus according to an exemplary embodiment of the present invention.

First, a general structure and an operation of an image forming apparatus according to an exemplary embodiment of the present invention are described. FIG. 1 shows an exemplary schematic structure of an image forming apparatus 100 according to this exemplary embodiment. In this exemplary embodiment, the image forming apparatus 100 is a laser-beam printer, which forms an image on a transfer material on the basis of an image information signal by electrophotography. The image information signal is sent to a main body 110 of the image forming apparatus 100 from an external apparatus (e.g., personal computer) connected to the main body 110 so as to be able to communicate with the main body 110. However, the present invention is not limited to the above structure. The present invention is widely applicable to other image forming apparatuses, such as a copier, a facsimile machine, or the like.

The image forming apparatus 100 includes a drum photosensitive member serving as an image carrier, i.e., a photosensitive drum 101. The photosensitive drum 101 is rotated in the direction of the arrow R1 in FIG. 1. The rotating photosensitive drum 101 is uniformly electrostatically charged by a charge roller (primary charging device) 102 serving as a charging unit. The charge roller 102 is rotated so as to follow the photosensitive drum 101 by coming into contact with the photosensitive drum 101. At this time, a charge bias having a potential with a predetermined polarity (in this exemplary embodiment, negative) is applied to the charge roller 102 from a charge-bias power source 121 serving as a charge-bias application unit.

In response to the image information input from the external apparatus, the photosensitive drum 101 is then radiated with light from an exposure device (laser scanner) 103 serving as an exposure unit. This forms an electrostatic image (latent image) on the photosensitive drum 101.

The electrostatic image formed on the photosensitive drum 101 is developed with a developer by a developing device 104 serving as a developing unit. In this exemplary embodiment, the developing device 104 uses as the developer non-magnetic single-component developer T (hereinafter referred to as toner) having a triboelectric polarity identical with the polarity of an applied voltage from the charge roller 102 (in this exemplary embodiment, negative). In this way, the electrostatic image on the photosensitive drum 101 is made be a visible image (toner image).

The toner image formed on the photosensitive drum 101 is transferred to a transfer material Q by a transfer roller (transfer charge device) 105 serving as a transfer unit. At this time, a transfer bias having a polarity opposite to a toner charge polarity (in this exemplary embodiment, positive) is applied to the transfer roller 105 from a transfer-bias power source 151 serving as a transfer-bias application unit. Before the toner image is transferred, the transfer material Q is conveyed to a transfer portion via a transfer unit 130, including a cassette 131 serving as a recording-material accommodation portion, a supply roller 132, and registration rollers 133.

After the toner image is transferred, the transfer material Q is separated from the photosensitive drum 101 and then conveyed to a fixing device 107. The toner image on the transfer material Q is fixed by heat and pressure from the fixing device 107, and then the image is made permanent. After that, the transfer material Q is ejected from the main body 110.

The toner T remaining on the photosensitive drum 101 without being transferred by the transfer roller 105 is removed by a cleaning device 106 serving as a cleaning unit. In this way, the photosensitive drum 101 is ready for the next image forming process.

In this exemplary embodiment, a single-color image forming apparatus including a single image formation portion is described by way of example. However, the present invention is not limited to this type. For example, the present invention is applicable to an image forming apparatus that includes a plurality of image forming portions for forming respective images of different colors and transfers images of different colors from the respective photosensitive drums 101 to a transfer material directly or through a primary transfer of transferring them to an intermediate transfer member and a secondary transfer of transferring them from the intermediate transfer member to the transfer material. The present invention is also applicable to an image forming apparatus that includes a plurality of developing devices for the single photosensitive drum 101. The images of different colors successively formed on the photosensitive drum 101 are transferred to the transfer material directly or through a primary transfer of transferring the images to an intermediate transfer member and a secondary transfer of transferring the images from the intermediate transfer member to the transfer material. These image forming apparatuses can form a full-color image, for example.

In this exemplary embodiment, the photosensitive drum 101 and the process unit acting on the photosensitive drum 101, which includes the charge roller 102, the developing device 104, and the cleaning device 106, are formed into a cartridge by using a development frame so as to constitute a process cartridge 120. The process cartridge 120 is removably mounted to the main body 110 via a mounting unit 111 mounted on the main body 110 (e.g., a mount guide and a positioning member). However, the present invention is not limited to this type. The process cartridge can have any structure as long as the image carrier and at least the developing unit are integrally formed into a cartridge attachable to and removable from the main body. Furthermore, the process cartridge can have a structure in which at least one of the charging unit and the cleaning unit is integrally formed into a cartridge. The cartridge attachable to and removable from the main body is not limited to the process cartridge. The developing device can be singularly formed as a cartridge attachable to and removable from the main body (development cartridge).

[Developing Device]

Figure 2:
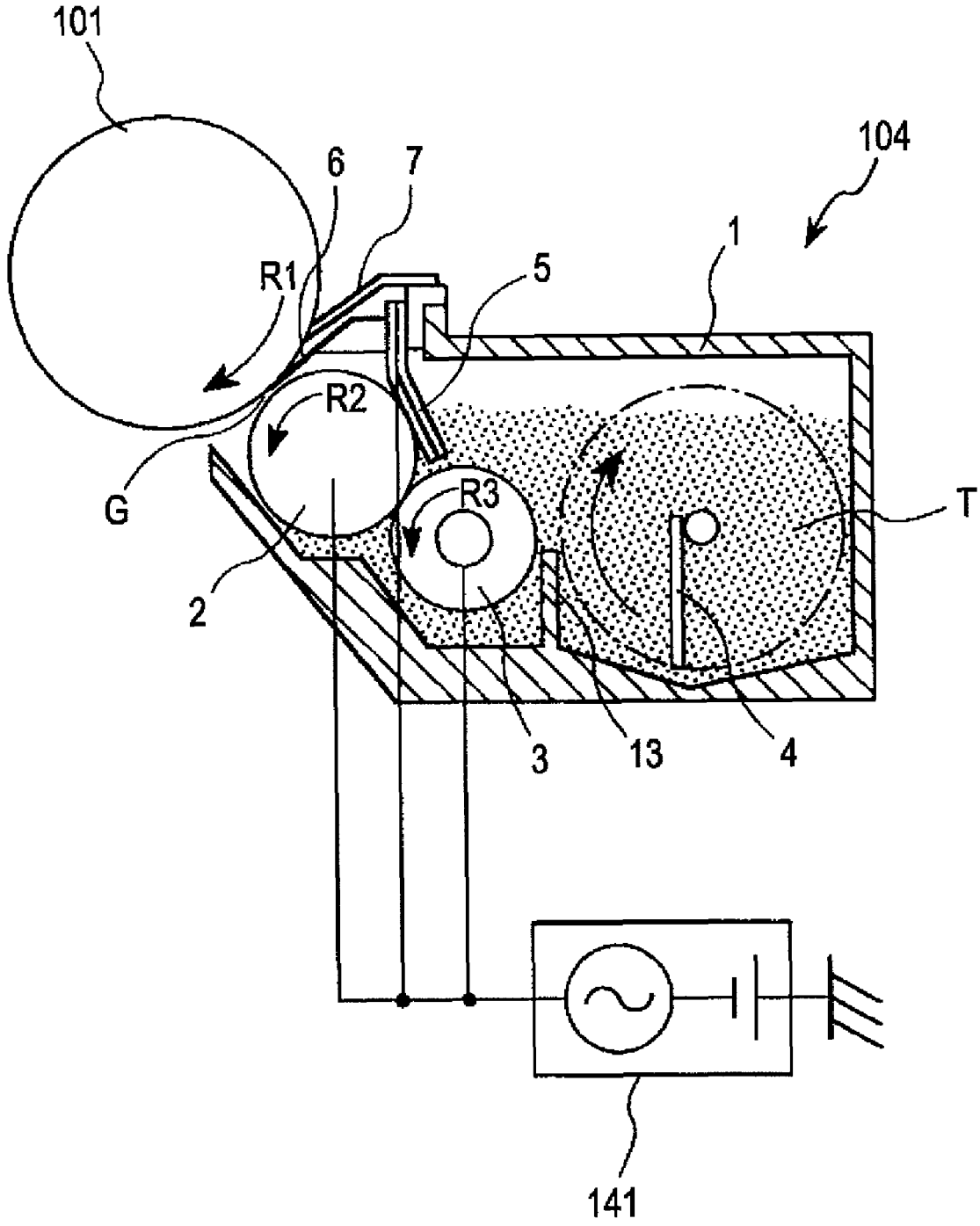
FIG. 2 is a schematic cross-sectional view of a developing device according to an exemplary embodiment of the present invention.

The developing device 104 is further described below with reference to FIG. 2. The developing device 104 according to this exemplary embodiment uses the non-contact non-magnetic single-component development system.

The developing device 104 includes a development container (development frame) 1 accommodating a developer. The development container 1 has an opening at a part that faces the photosensitive drum 101, and a development roller 2 serving as the developer carrier is disposed in the opening. The development roller 2 is in contact with a developer supply/peel roller (hereinafter referred to as RS roller) 3. The development roller 2 is also in contact with a regulating blade 5 serving as a member of regulating the thickness of a developer layer. Within the development container 1, an agitation member 4 for agitating and conveying the developer is disposed. The developing device 104 also includes a developer flying control member 6 and a development-noise control member 7. The details are described below.

The developer used in this exemplary embodiment is a negatively chargeable insulating non-magnetic single-component developer containing a pigment of yellow, magenta, cyan, or black, i.e., the toner T.

Examples of the agitation member 4 include plate members having various shapes and a screw. In this exemplary embodiment, a single agitation blade in which a plate member is mounted on a rotating shaft is disposed in the development container 1. The agitation member 4 rotates in the direction of the arrow in FIGS. 1 and 2 and conveys the toner T in the toner accommodation container toward the development roller 2.

The number of agitation member is not limited to one. The number of agitation members is any number as long as the toner can be conveyed from the end of the development container to the adjacent areas of the developer carrier in response to variations in the structure of the developing device.

Within the development container 1, a development-container partition 13 is disposed. The height of the partition 13 is appropriately adjusted so that a predetermined amount of toner T is consistently supplied to the surface of the RS roller 3 adjacent to the development roller 2.

For the non-magnetic single-component development system, it is impossible to supply the toner T to the development roller 2 by magnetism. Therefore, the development roller 2 is in contact with the polyurethane sponge RS roller 3. The development roller 2 and the RS roller 3 rotate in the direction of an arrow of R2 and that of an arrow of R3 in FIG. 2, respectively. In other words, the development roller 2 and the RS roller 3 rotate so that the direction of movement of the surface of the development roller 2 is opposite (counter) to that of the RS roller 3 at a nip portion. Therefore, the RS roller 3 can supply the toner T to the surface of the development roller 2 and can also peel, from the surface of the development roller 2, the toner T that remains on the development roller 2 after the toner T passes through a developing area G disposed at a position where the development roller 2 faces the photosensitive drum 101.

The development roller 2 is in contact with the regulating blade 5. The regulating blade 5 regulates the toner T on the development roller 2, forms a thin toner layer, and defines the amount of toner T to be conveyed to the developing area G. The regulating blade 5 electrostatically charges the toner carried on the development roller 2 by friction. The amount of toner T to be conveyed to the developing area G is determined on the basis of a contact pressure of the regulating blade 5 being in contact with the development roller 2, a contact length thereof, and/or other factors. The regulating blade 5 is attached or welded to the surface of a metal thin plate having a thickness of, for example, several hundred micrometers. Examples of the metal thin plate include a phosphor-bronze plate and a stainless plate. The regulating blade 5 according to this exemplary embodiment is a tip blade that is uniformly in contact with the development roller 2 by elasticity of the metal thin plate. The conditions of contact of the regulating blade 5 are determined on the basis of the material of the metal thin plate, the thickness, the amount of entry, the set angle, and/or other factors.

The development roller 2 is located so as to face the photosensitive drum 101 with a predetermined gap between the development roller 2 and the surface of the photosensitive drum 101 (hereinafter referred to as SD gap) at the developing area G. The photosensitive drum 101 and the development roller 2 rotate in the direction of an arrow of R1 and that of R2 in FIG. 2, respectively. In other words, the photosensitive drum 101 and the development roller 2 rotate so that the direction of movement of the surface of the photosensitive drum 101 and that of the development roller 2 are the forward direction at an opposing portion. The development roller 2 is connected to a development-bias power source 141 serving as a development-bias application unit. In a development process, a predetermined development bias is applied to the development roller 2 from the development-bias power source 141. In this exemplary embodiment, as the development bias, a superposition voltage of a direct-current voltage component (direct-current bias) having a polarity identical with the electrostatic charge polarity of the photosensitive drum 101 (in this exemplary embodiment, negative) and an alternating-current voltage component (alternating-current bias) is applied to the development roller 2. This forms an alternating-current electric field between the photosensitive drum 101 and the development roller 2.

When the toner T having a predetermined amount of electrostatic charge and a predetermined thickness attached to the surface of the development roller 2 is conveyed to the developing area G, the alternating-current electric field formed between the photosensitive drum 101 and the development roller 2 causes the toner T to reciprocate between the development roller 2 and the photosensitive drum 101. Therefore, the toner T becomes attached to the electrostatic image formed on the surface of the photosensitive drum 101, so that the electrostatic image is visualized with the toner T.

In this exemplary embodiment, the photosensitive drum 101 is formed by coating the surface of an aluminum element tube having a diameter of 30 mm with a photosensitive material such as an organic photoconductor (OPC). The development roller 2 is formed by spraying phenolic resin solution in which carbon and graphite are dispersed onto the surface of an aluminum element tube having a diameter of 16 mm. Regulating rollers (not shown) for regulating the SD gap (gap between the photosensitive drum 101 and the development roller 2) are disposed on both ends of the development roller 2 in the longitudinal direction (a direction transverse to the direction of movement of the surface). The regulating rollers abut the surface of the photosensitive drum 101, thereby maintaining the SD gap. In this exemplary embodiment, the SD gap is 300 μm. The RS roller 3 is formed by covering the periphery of a core metal having a diameter of 5 mm with a polyurethane foam having a thickness of 4.5 mm. The regulating blade 5 is formed by coating a phosphor-bronze plate having a thickness of 100 μm with an insulating polyamide (PA) resin. In order to make the layer of the toner T on the surface of the development roller 2 thin and uniform, the regulating blade 5 abuts the development roller 2 with a line pressure of 30 g/cm so that an end of the regulating blade 5 faces upstream of the direction of rotation of the development roller 2 (counter direction).

For the image forming apparatus 100 according to this exemplary embodiment, the main body 110 includes an environmental sensor 108 for sensing environmental temperature and humidity, the environmental sensor 108 serving as an environmental sensing unit for outputting a signal in accordance with the temperature and/or humidity of an environment of the apparatus. The set value of the development bias is changed on the basis of the output value of the environmental sensor 108 mounted in the main body 110.

The frequency of the alternating-current voltage component of the development bias (hereinafter referred to simply as the frequency of the AC bias) is set high under low temperature and low humidity because the toner T is easy to fly in such a condition. In contrast, the frequency of the AC bias is set low under high temperature and high humidity because the toner T is difficult to fly in such a condition.

More specifically, in this exemplary embodiment, the optimal value of the frequency of the AC bias is calculated on the basis of an experiment, and the frequency of the AC bias is set as follows: for high temperature and high humidity, the frequency of the AC bias is set at a first frequency, $\alpha 1$, of 3000 Hz, and for low temperature and low humidity, the frequency of the AC bias is set at a second frequency, $\alpha 2$, of 4100 Hz.

In this exemplary embodiment, the frequency of the AC bias is set so as to be switchable between the first frequency $\alpha 1$ and the second frequency $\alpha 2$.

The development bias is a bias in which a direct-current bias of −250 V is superimposed on an alternating-current bias whose amplitude (peak-to-peak voltage) is 3000 V. Furthermore, in this exemplary embodiment, the development bias is applied also to the RS roller 3 and the regulating blade 5.

The frequency of the AC bias is controlled by a control unit 109. Signals output from the environmental sensor 108 in accordance with the temperature and/or humidity are input to the control unit 109. The control unit 109 controls the development bias to be applied from the development-bias power source 141 to the charge roller 102 and other elements depending on the output values from the environmental sensor 108. In particular, in this exemplary embodiment, the control unit 109 switches the frequency of the AC bias between the first frequency $\alpha 1$ and the second frequency $\alpha 2$, which is higher than the first frequency $\alpha 1$, depending on the output values from the environmental sensor 108. The control unit 109 can be a central processing unit (CPU) controlling the operation of the image forming apparatus in addition to the development bias.

The control unit 109 can calculate the absolute humidity in the air as information on the environmental temperature and humidity on the basis of a signal from the environmental sensor 108, compare the calculated value with a predetermined threshold for the absolute humidity, and thereby appropriately select the frequency of the AC bias.

(Developer Flying Control Member)

The developer flying control member 6 as a developer flying regulation member is described below.

Figure 3:
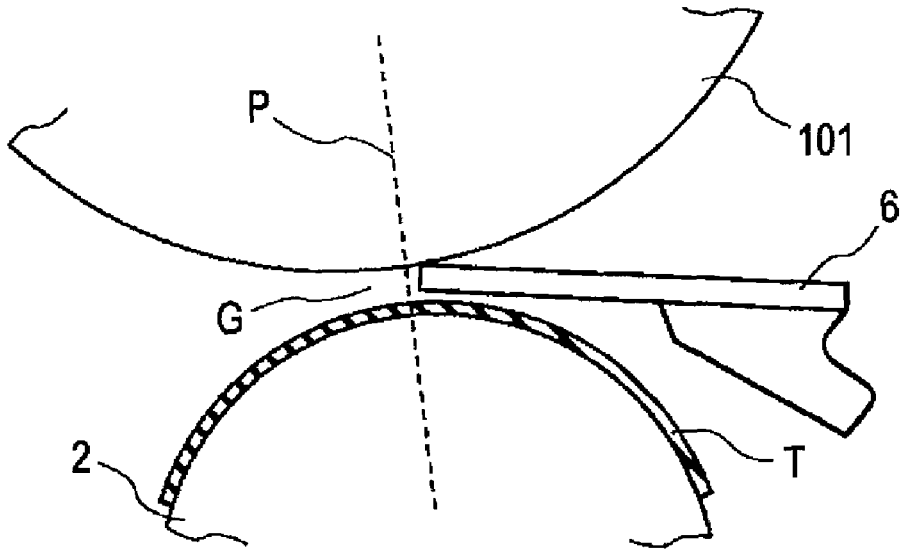
FIG. 3 is an enlarged view of a developing area of the image forming apparatus illustrated in FIG. 1.

FIG. 3 is an enlarged view of the developing area G and the adjacent areas thereof in the developing device 104 according to this exemplary embodiment. The developer flying control member 6 is disposed so that an end thereof enters the developing area G in the vicinity of a line segment P which joins the center of the photosensitive drum 101 and that of the development roller 2.

The definition of the developing area G and a measurement procedure therefor are described below. In the developing device 104, in a state where the electrostatically charged toner T is attached to the surface of the development roller 2 and in a state where the photosensitive drum 101 and the development roller 2 stop, an AC bias that is sufficient for the toner T on the development roller 2 to fly is applied to the development roller 2. At this time, on the surface of the development roller 2 in the vicinity of the surface of the photosensitive drum 101, there exists a first region where the toner T is absent or where there is a toner layer whose toner amount is smaller than the other areas and a second region, disposed on both ends of the first region, where there is a toner layer whose toner amount is larger than the other areas. One model of this state is illustrated in FIG. 4.

Figure 4:
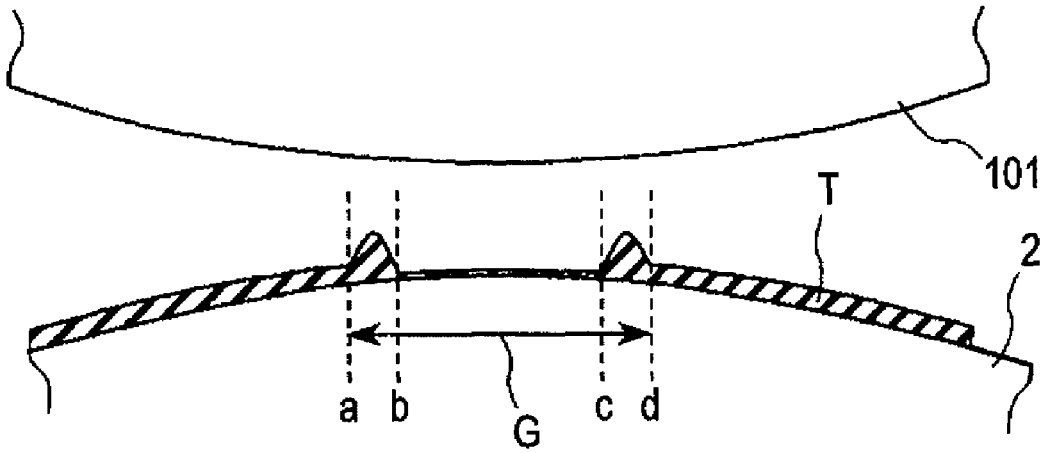
FIG. 4 is a schematic illustration for describing the definition of the developing area.

The second region (thicker toner layer) is a region between a and b and between c and d in FIG. 4. The first region (absence of the toner T or thinner toner layer) is a region between b and c in FIG. 4. In FIG. 4, the developing area G is defined as a region between a and d. The width of the developing area G varies with the diameters of the photosensitive drum 101 and the development roller 2, the SD gap, environmental conditions (e.g. temperature, humidity, and atmospheric pressure), the development bias, the applying time of the development bias, the amount of electrostatic charges of the toner T, and the amount of toner attached to the surface of the development roller 2.

As previously described, the developer flying control member 6 is provided to reduce a sweep-together phenomenon. The position where the developer flying control member 6 is set is described below.

First, an image in which a sweep-together phenomenon occurs and an evaluation procedure therefor are described. The noticeability of the sweep-together phenomenon increases with the difference of potentials of latent images on the photosensitive drum 101. For example, an image having a solid image portion (which has the maximum density level) and a solid white image portion (which has the minimum density level, i.e., where toner is not to be placed) subsequent to the solid image portion is noticeable.

Figure 5:
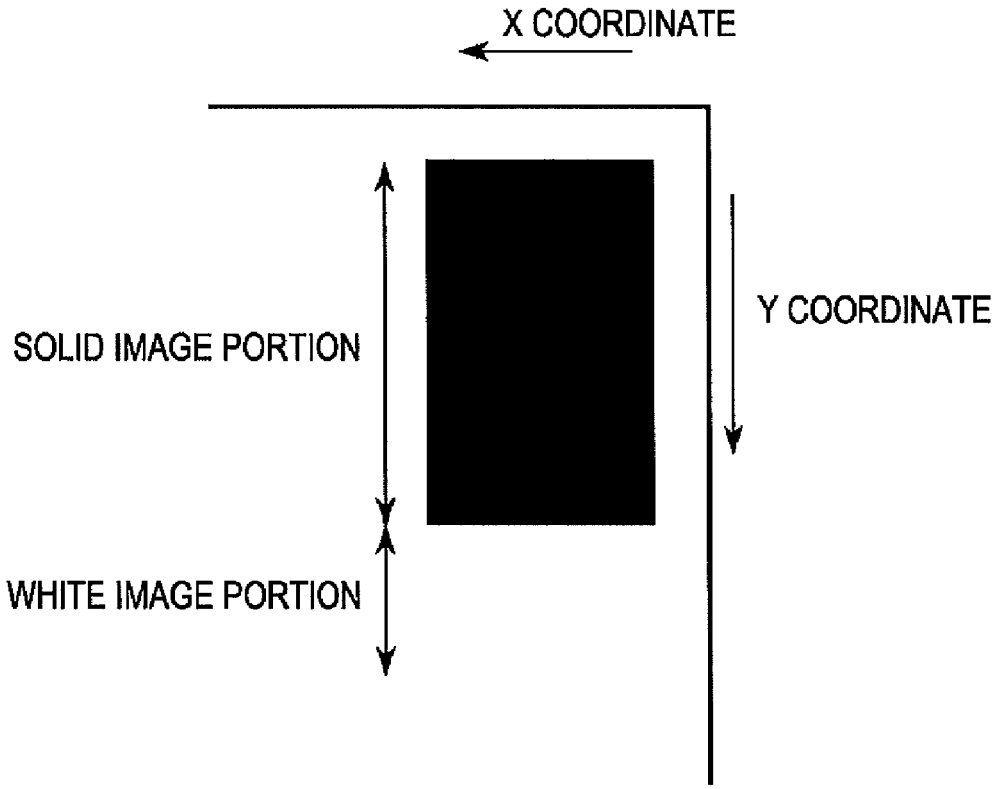
FIG. 5 is an illustration for describing a sample image in evaluation tests for a sweep-together phenomenon.
Figure 6:
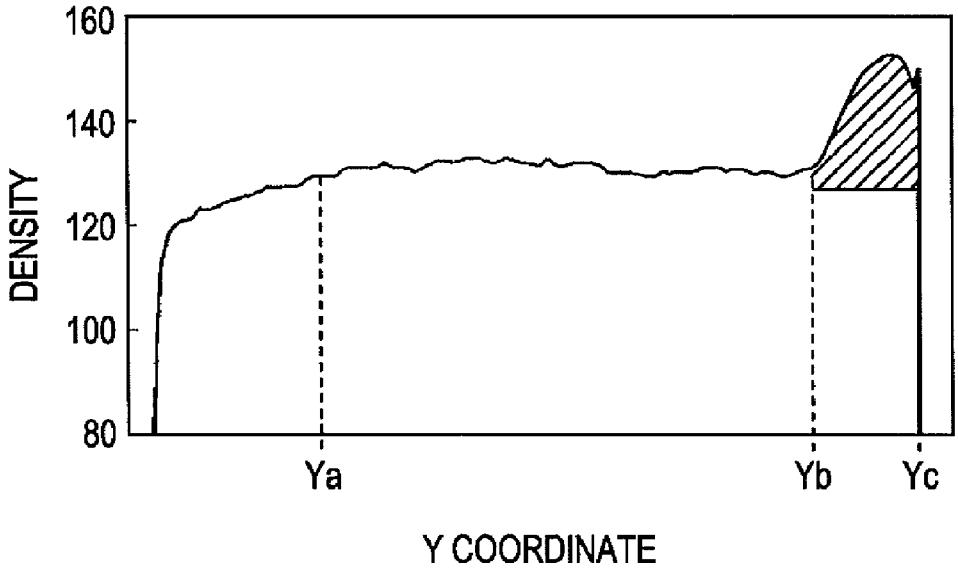
FIG. 6 is a graph for describing conversion of sweep-together phenomena into numbers.

FIG. 5 illustrates a part of an image pattern used for examining effects of the developer flying control member 6. The image pattern illustrated in FIG. 5 is an image having a solid image portion of 30 mm long (the direction of movement of the surface of the photosensitive drum 101)×20 mm wide (a direction that is substantially orthogonal to the direction of movement of the surface of the photosensitive drum 101) and a solid white image portion subsequent to the solid image portion. The image is captured in a personal computer by using an image scanner system, and the image densities are converted into numerical data from 0 to 255. FIG. 6 illustrates the density distribution of a sample image in the longitudinal direction (y-axis).

A procedure for converting a sweep-together phenomenon into a number is described below. In FIG. 6, the density of a range between Yb and Yc is larger than that of a range between Ya and Yb. In other words, the range between Yb and Yc indicates a sweep-together image. The diagonally shaded area in FIG. 6 is an integrated value of the density of the sweep-together image, and the change in density per 1 mm is defined as a sweep-together value. In the case of the data illustrated in FIG. 6, a value of a region of Yb-Yc of the sweep-together image is 4 (mm), and an integrated value of the density of the sweep-together image (diagonally shaded area) is 160 (dig). As a result, the sweep-together value is calculated by dividing 160 by 4, i.e., 40 (dig/mm).

According to an experiment conducted by the inventor et al., if the sweep-together value is no larger than 20 (dig/mm), the sweep-together image is less pronounced visually. Therefore, a sweep-together value that is no larger than 20 (dig/mm) is defined as a good image.

Figure 7:
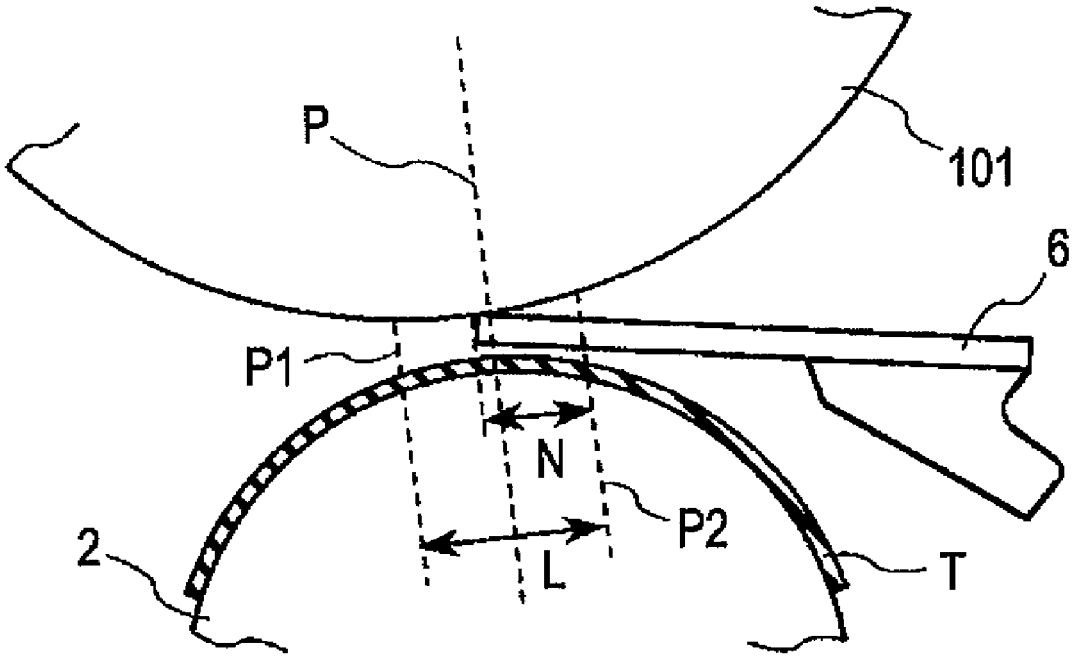
FIG. 7 is a model diagram for describing the position of a developer flying control member in the developing area.

FIG. 7 is an enlarged view of the developing area G and the adjacent areas according to this exemplary embodiment. The developing area G is defined as a range between a point P1 and a point P2, and the length thereof is defined as L. The amount of entry of the developer flying control member 6 with respect to the developing area G is defined as a range between the leading end of the developer flying control member 6 and the point P2, and the length thereof is defined as N.

Figure 8:
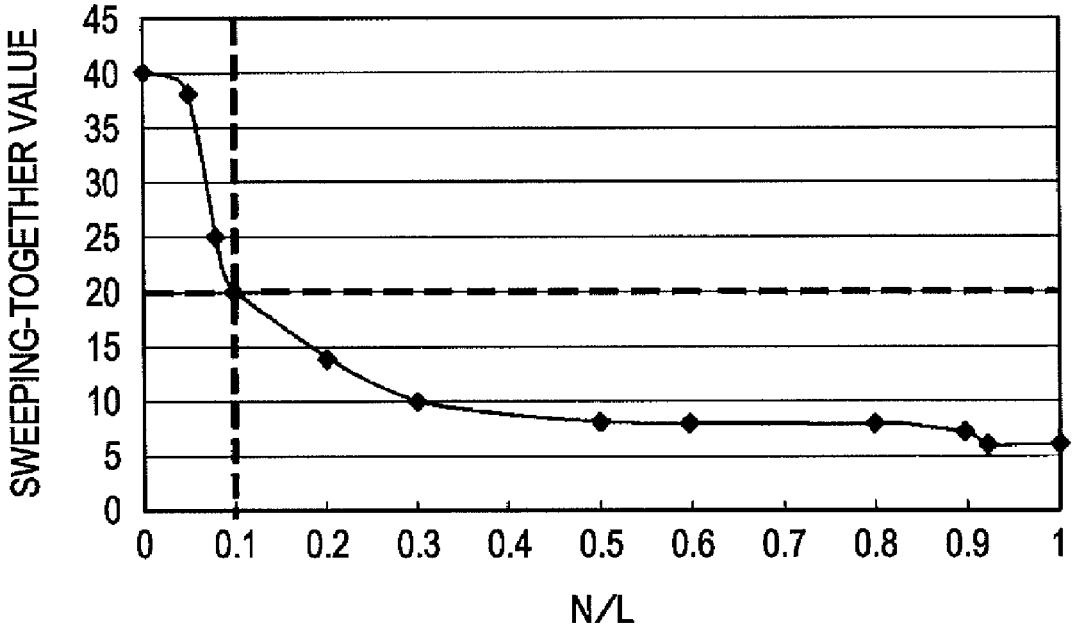
FIG. 8 is a graph illustrating the relationship between sweep-together values and N/L.

FIG. 8 illustrates how the sweep-together value is changed when the N/L value is changed. As shown in FIG. 8, when the value of N/L is equal to or larger than 0.1, the sweep-together value exhibits 20 or less, and therefore, a good image can be obtained.

Figure 9:
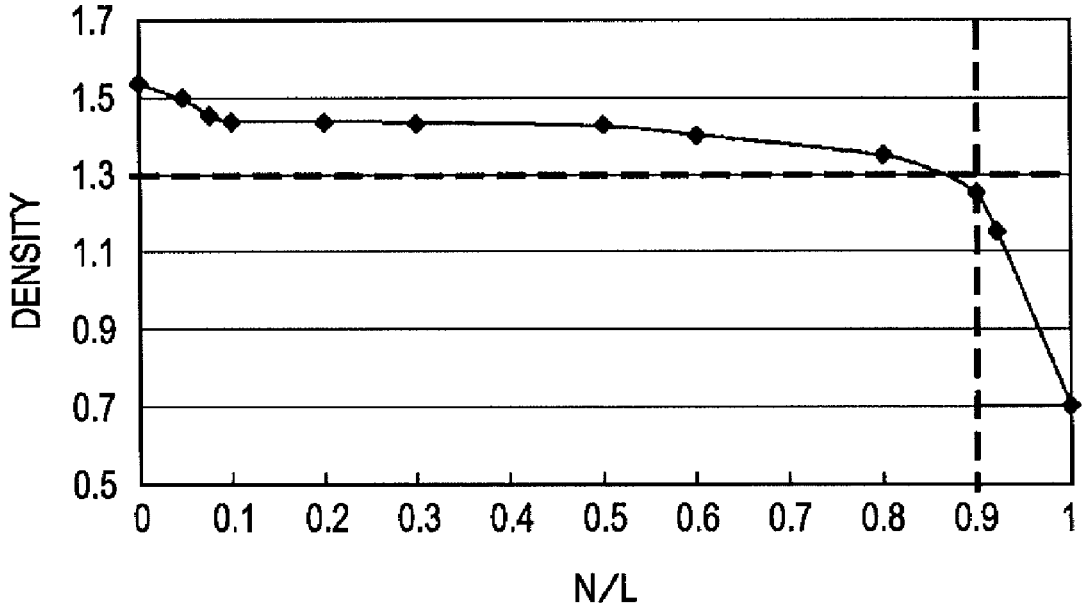
FIG. 9 is a graph illustrating the relationship between densities of a sample image and N/L.

FIG. 9 illustrates how the density of the solid image portion of the evaluated image is changed when the N/L value is changed. For measurement of the densities, Macbeth Series 1200 was used. As shown in FIG. 9, when the N/L value is equal to or larger than 0.9, the image density is low.

In other words, positioning the developer flying control member 6 so as to satisfy $0.1 \leqq N/L \leqq 0.9$ can reduce a sweep-together phenomenon.

When the sweep-together value is equal to or smaller than 10 (dig/mm), the sweep-together image is invisible. When the density of the solid image portion is equal to or larger than 1.4, a good image can be obtained even under low temperature and low humidity.

Consequently, it is useful that the developer flying control member 6 is disposed so as to satisfy $0.3 \leqq N/L \leqq 0.6$. Furthermore, it is useful that the developer flying control member 6 is disposed so as to be in contact with the photosensitive drum 101 without being in contact with the development roller 2.

Figure 10:
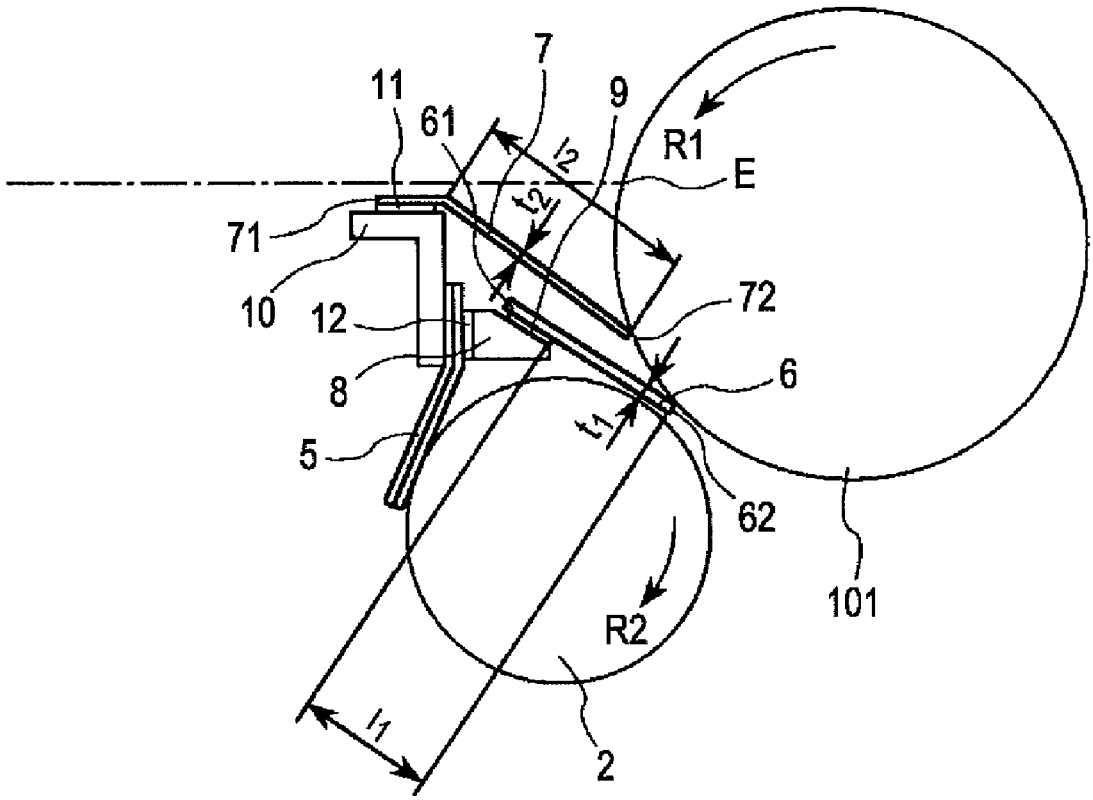
FIG. 10 is a cross-sectional view of the developer flying control member, a development-noise control member, and their surroundings according to an exemplary embodiment of the present invention.
Figure 11:
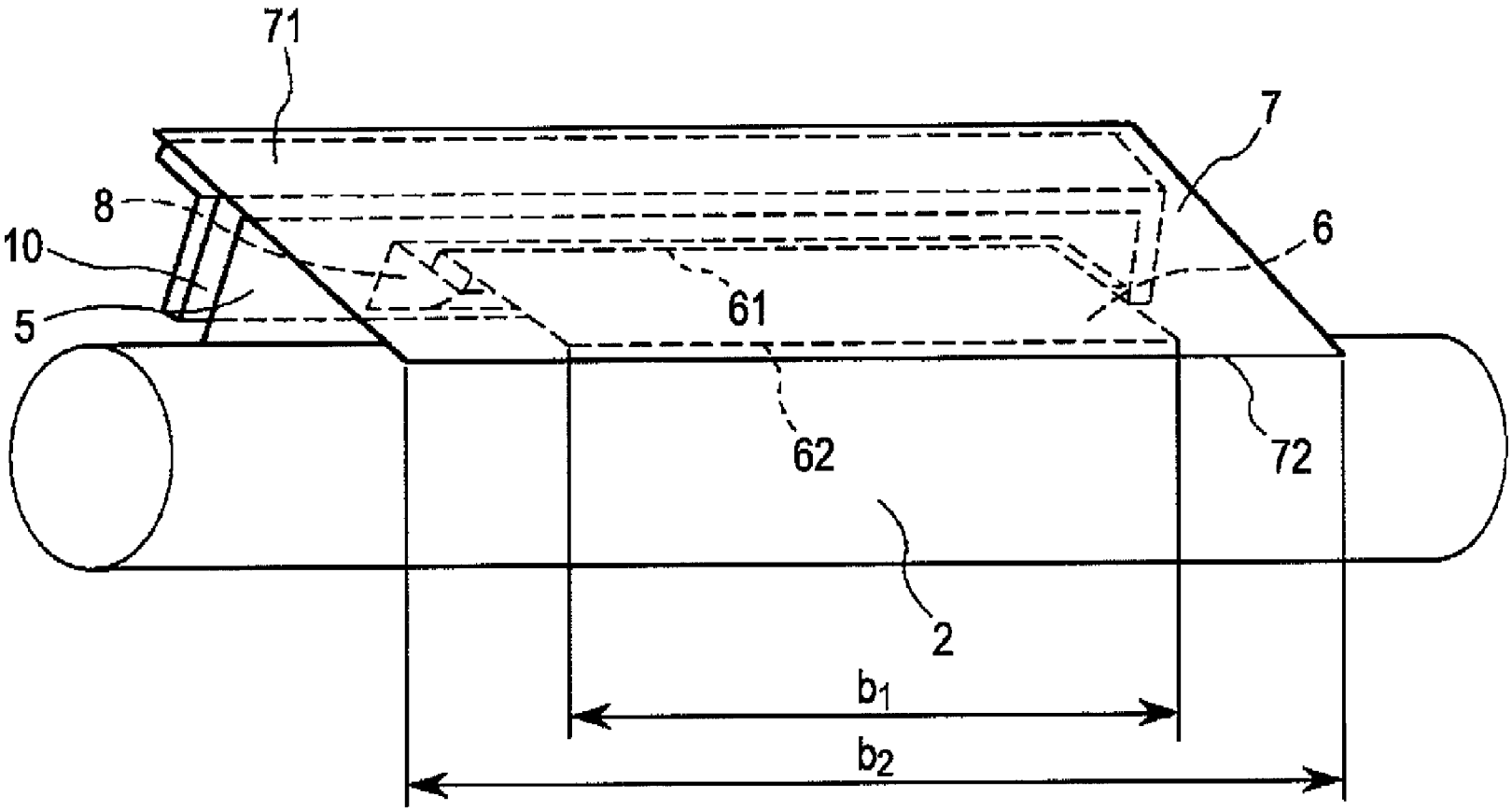
FIG. 11 is a schematic plan view of the developer flying control member, the development-noise control member, and their surroundings according to an exemplary embodiment of the present invention.

The developer flying control member 6 is further described below with reference to FIGS. 10 and 11. In this exemplary embodiment, the developer flying control member 6 is formed from a flexible sheet. Examples of the flexible sheet include a sheet made from a material that is relatively inexpensive and thin but bears rigidity (e.g., polyethylene terephthalate (PET), polyethylene (PE), and polystyrene (PS)). For the developer flying control member 6, one end (first end) 61 is secured to a support base 8. In this exemplary embodiment, the developer flying control member 6 is secured to the support base 8 with double-sided adhesive tape 9. However, it can be secured by any available method, such as the use of adhesives, fusing, or the like. The other end (second end) 62 of the developer flying control member 6 is disposed between the photosensitive drum 101 and the development roller 2 while being in contact with the photosensitive drum 101, as previously described.

The developer flying control member 6 is disposed on a surface of the support base 8 that faces the photosensitive drum 101. However, the developer flying control member 6 can be disposed on another surface of the support base 8 that faces the development roller 2.

The support base 8 is secured to a surface on which the regulating blade 5 is mounted to a support metal plate 10 via the regulating blade 5 disposed therebetween. The support metal plate 10 has an L-shaped cross section, for example. In this exemplary embodiment, the support base 8 is secured to the regulating blade 5 with double-sided tape 12. However, it can be secured by any available method, as in the above case.

Furthermore, it is useful that the width of the developer flying control member 6 in the longitudinal direction (a direction transverse to the direction of movement of the surface of the photosensitive drum) is set so that the developer flying control member 6 covers the image area along the same direction to facilitate reduction effects of reducing a sweep-together phenomenon.

More specifically, in this exemplary embodiment, the developer flying control member 6 is a sheet made from PET having a thickness, t1, of 0.1 mm. The free length, l1, of the developer flying control member 6 (length from the secured portion to an end adjacent to the photosensitive drum in the direction along the direction of movement of the surface of the photosensitive drum) is 3 mm, and the width, b1, of the developer flying control member 6 (length in a direction transverse to the direction of movement of the surface of the photosensitive drum) is 225 mm.

In this exemplary embodiment, the width of the image area in the direction transverse to the direction of movement of the surface of the photosensitive drum 101 is 222 mm.

(Development-Noise Control Member)

The development-noise control member 7 as a development-noise regulation member is described next. As described below, the development-noise control member 7 is provided to suppress the development noise (AC noise) mentioned above.

In this exemplary embodiment, the development-noise control member 7 is formed from a flexible sheet. Examples of the flexible sheet include a sheet made from polyethylene terephthalate (PET), polyethylene (PE), polystyrene (PS), or other materials. For the development-noise control member 7, one end (first end) 71 is secured to a surface of the support metal plate 10, which has an L-shaped cross section, the surface being substantially orthogonal to the surface securing the regulating blade 5. In this exemplary embodiment, the development-noise control member 7 is secured to the support metal plate 10 with double-sided tape 11. However, it can be secured by any available method, as in the above case. The other end (second end) 72 of the development-noise control member 7 is in contact with the photosensitive drum 101 in the vicinity of the end (second end) 62 of the developer flying control member 6. The contact position is upstream of the end (second end) 62 of the developer flying control member 6 in the direction of movement of the surface of the photosensitive drum 101 and downstream of a position E on the photosensitive drum 101 where an electrostatic image is written (exposure position) by exposure performed by the exposure device 103.

The width of the development-noise control member 7 in the longitudinal direction (a direction transverse to the direction of movement of the surface of the photosensitive drum) is set so as to be equal to or longer than the width of the developer flying control member 6 in the same direction.

More specifically, in this exemplary embodiment, the development-noise control member 7 is a sheet made from PET having a thickness, t2, of 0.1 mm. The free length, l2, of the development-noise control member 7 (length from the secured portion to an end adjacent to the photosensitive drum in the direction along the direction of movement of the surface of the photosensitive drum) is 8.5 mm, and the width, b2, of the development-noise control member 7 (length in a direction transverse to the direction of movement of the surface of the photosensitive drum) is 228 mm.

(Suppression of AC Noise)

Figure 12:
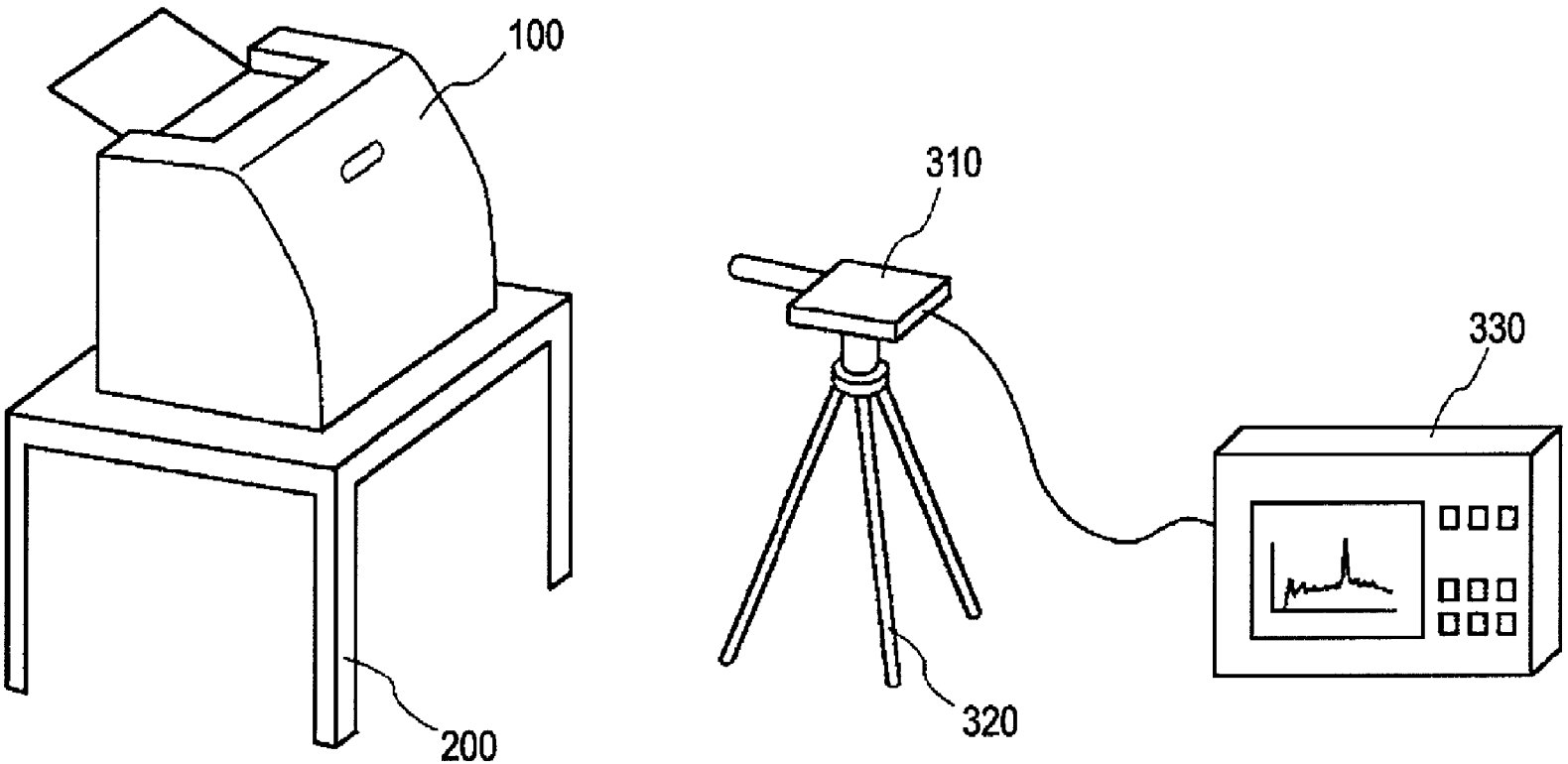
FIG. 12 is a schematic diagram for describing a method for measuring AC noise.

A method for measuring AC noise is described below with reference to FIG. 12.

The image forming apparatus 100 was placed on an apparatus table 200 at a height that would be typically used by a user. In this exemplary embodiment, the image forming apparatus 100 was placed so that the top panel thereof was disposed at a height of the user's chest.

A microphone 310 was placed in the vicinity of the front of the image forming apparatus 100 at a position that would be closest to the user's ear on a tripod 320. In this exemplary embodiment, the microphone 310 was placed at a position 70 cm away from the front of the image forming apparatus 100 and 90 cm away from the ground.

Figure 13:
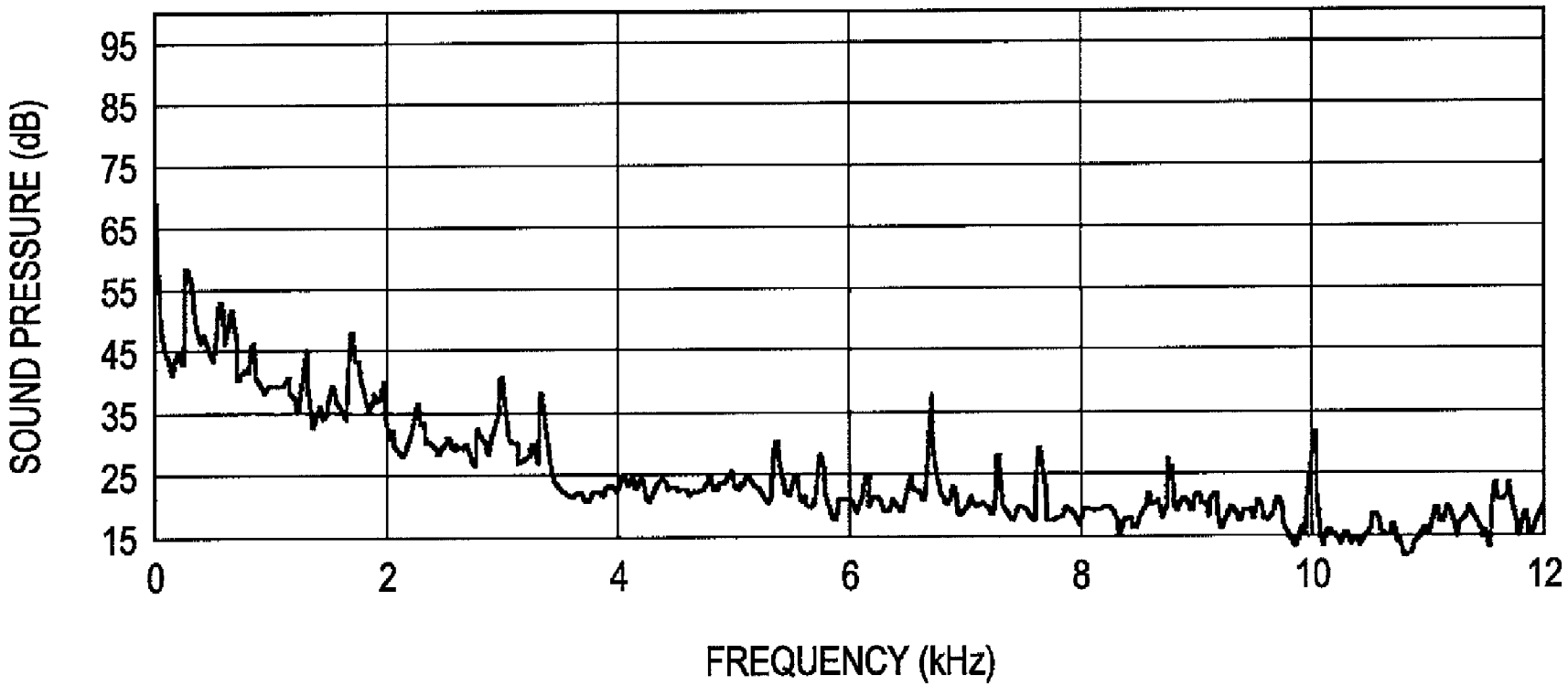
FIG. 13 is a graph illustrating an example of measurement results of AC noise.

As for noise picked up by the microphone 310, the sound pressure level (dB) at a corresponding frequency was measured by the use of an FFT analyzer 330 for performing frequency analysis. An example of measured data is shown in FIG. 13.

The definition of the natural frequency of each of the developer flying control member 6 and the development-noise control member 7 is described below.

In the case of a cantilever, which is fixed at one end only, the natural frequency can be represented by the following Expression (1):

$$fm=(1/2\pi)\times(\lambda)^2/l^2\times\sqrt{(Ed^2/12\rho)} \quad (1)$$

where l represents the free length, d represents the thickness, E represents the Young's modulus, ρ represents the density, and λ represents a specific constant.

This shows that the natural frequency of each of the developer flying control member 6 and the development-noise control member 7 is uniquely determined by design of a single sheet. It is generally known that, when the number of oscillations (=frequency) of the AC bias given as an external force approaches the natural frequency, an increase in amplitude called resonance occurs. When the increase in amplitude becomes larger, the sound pressure level of the development noise (AC noise) inevitably becomes larger.

Figure 14:
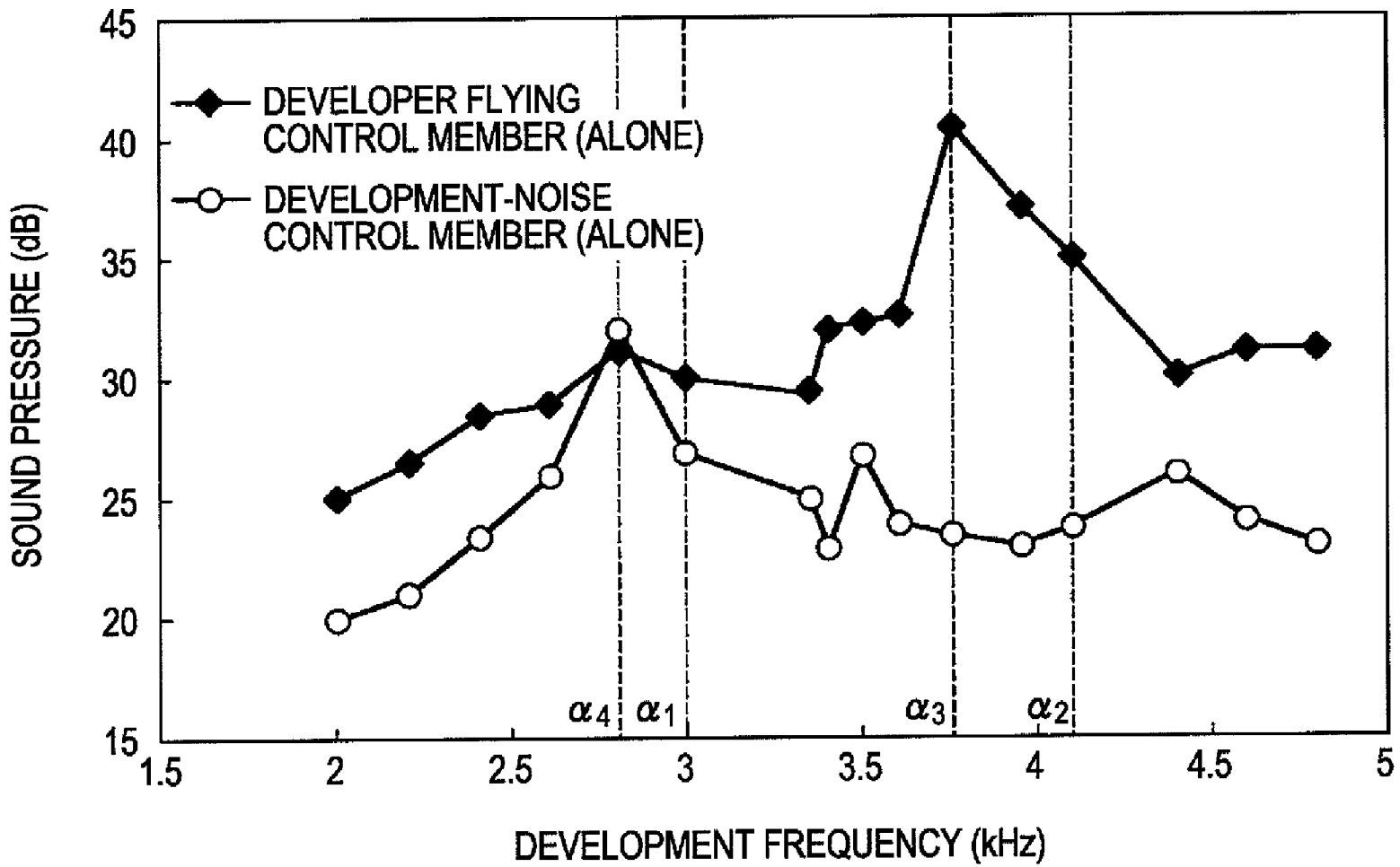
FIG. 14 is a graph illustrating measurement results of AC noise for the developing device with the developer flying control member mounted alone and for the developing device with the development-noise control member mounted alone.

The AC noise was measured for the developing device 104 with the developer flying control member 6 mounted alone, i.e., the developing device 104 with the development-noise control member 7 removed. As illustrated in FIG. 14, the measurement results revealed that the sound pressure level exhibited a peak value at a frequency when the AC frequency was changed. The frequency (=the number of oscillations) at which the peak value is exhibited is the natural frequency of the developer flying control member 6.

As previously described, the image forming apparatus 100 according to the exemplary embodiment changes the frequency of the AC bias depending on environment, although not limited to this. According to the structure in this exemplary embodiment, the frequency at the peak value (the natural frequency of the developer flying control member 6), i.e., the third frequency $\alpha 3$ of 3800 Hz and the adjacent frequencies are near to the second frequency $\alpha 2$ of the AC bias of 4100 Hz. As a result, the provision of the developer flying control member 6 alone increases the AC noise because of resonance effects.

The experiment revealed that if the natural frequency of the developer flying control member 6 was set at a frequency remote from the first frequency $\alpha 1$ and the second frequency $\alpha 2$ of the AC bias, it was possible to reduce the AC noise in itself. In this case, however, when the developer flying control member 6 does not vibrate, the toner T flying within the developing area G may be then attached to the developer flying control member 6, the attached toner T may form lumps, and the lumps may be transferred to the transfer material Q via the photosensitive drum 101 ("toner drops").

Therefore, it is useful that the natural frequency $\alpha 3$ of the developer flying control member 6 is set at between the first frequency $\alpha 1$ and the second frequency $\alpha 2$ of the AC bias.

The end (second end) 72 of the development-noise control member 7 is disposed in the vicinity of the end of the developer flying control member 6 and is in contact with the photosensitive drum 101. Therefore, even when the end (second end) 72 of the development-noise control member 7 is not present within the developing area G, the resonance occurs at a natural frequency because of the oscillation of the frequency of the AC bias transmitted to the surface of the photosensitive drum 101.

FIG. 14 also illustrates the measurement results when the AC noise was measured for the developing device 104 with the development-noise control member 7 mounted alone, i.e., the developing device 104 with the developer flying control member 6 removed. As illustrated in FIG. 14, the measurement results revealed that the sound pressure level exhibited a peak value at a frequency when the AC frequency was changed. The frequency (=the number of oscillations) at which the peak value is exhibited is the natural frequency of the development-noise control member 7.

In this exemplary embodiment, the fourth frequency $\alpha 4$ which is the natural frequency of the development-noise control member 7 is set so as to be smaller than the first frequency $\alpha 1$ of the AC bias of 3000 Hz. In this exemplary embodiment, the fourth frequency $\alpha 4$, which is the natural frequency of the development-noise control member 7, is set at a value near 2800 Hz.

Both the first frequency $\alpha 1$ and the second frequency $\alpha 2$ of the AC bias are less prone to being resonated by the developer flying control member 6 and the development-noise control member 7. In addition, covering a space above the developer flying control member 6, which is a larger vibration source (=noise source), with the development-noise control member 7 can provide shielding effects.

Figure 15:
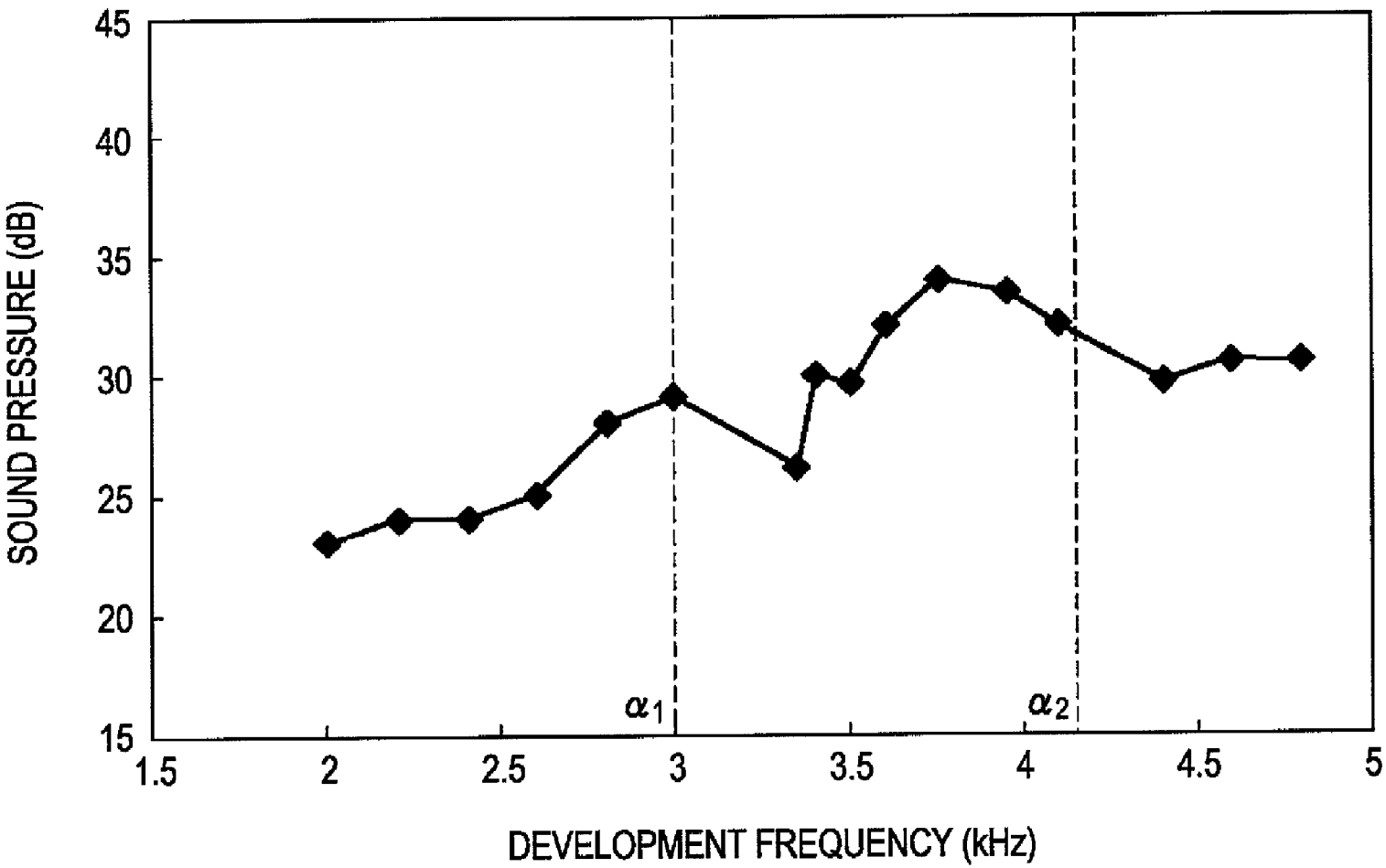
FIG. 15 is a graph illustrating effects of suppressing AC noise according to an exemplary embodiment of the present invention.
Figure 16:
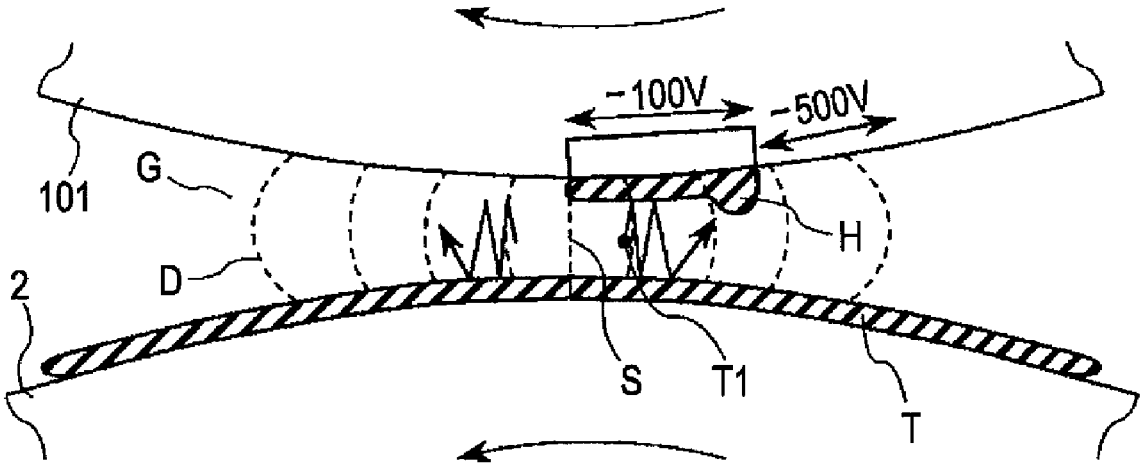
FIG. 16 is an illustration for describing a sweep-together phenomenon.

FIG. 15 illustrates measurement results of the AC noise for the developing device 104 including both developer flying control member 6 and the development-noise control member 7. According to this exemplary embodiment, the fourth frequency $\alpha 4$, which is the natural frequency of the development-noise control member 7, is set so as to be smaller than the first frequency $\alpha 1$ of the AC bias. As illustrated in FIG. 15, the sound pressure levels at both the first frequency $\alpha 1$ and the second frequency $\alpha 2$ of the AC bias are low. In this exemplary embodiment, the third frequency $\alpha 3$, which is the natural frequency of the developer flying control member 6, is set at a value between the first frequency $\alpha 1$ and the second frequency $\alpha 2$ of the AC bias. Toner drops did not occur.

Table 1 shows results of audibility tests. The tests were conducted for the developing device 104 according to the exemplary embodiment and for the developing device 104 with development-noise control member 7 removed, with respect to the first frequency $\alpha 1$ and that being the second frequency $\alpha 2$ as the frequency of the AC bias. The evaluations made by a test subject were shown in three grades of A (good), B (neither good nor bad), and C (bad).

TABLE 1

| Condition | Development Frequency (Hz) | Evaluation |
|---|---|---|
| Comparative Example (developer flying control member mounted alone) | 3000 | B |
| Comparative Example (developer flying control member mounted alone) | 4100 | C |
| First Exemplary Embodiment (development-noise control member added) | 3000 | A |
| First Exemplary Embodiment (development-noise control member added) | 4100 | A |

In the structure according to the exemplary embodiment, a good result (A) was obtained for both cases where the frequency of the AC bias was 3000 Hz (first frequency) and 4100 Hz (second frequency).

In the case where the fourth frequency $\alpha 4$, which is the natural frequency of the development-noise control member 7, is set at between the first frequency $\alpha 1$ and the second frequency $\alpha 2$ of the AC bias, the natural frequency of the developer flying control member 6 (third frequency $\alpha 3$) and the natural frequency of the development-noise control member 7 (fourth frequency $\alpha 4$) are close to each other. As a result, the shielding effects achieved by the development-noise control member 7 for the second frequency $\alpha 2$ of the AC bias cannot be expected.

In the case where the fourth frequency $\alpha 4$ is set so as to be larger than the second frequency $\alpha 2$, the Young's modulus E and the thickness d are typically increased, as can be seen from Expression (1). Although it is possible to increase the free length l, space may be limited. In this case, the rigidity of the sheet in itself may be increased, and this may cause the development-noise control member 7 to damage the photosensitive drum 101.

In contrast, when the fourth frequency $\alpha 4$ is set so as to be smaller than the first frequency $\alpha 1$, as in the exemplary embodiment, even for the second frequency $\alpha 2$, at which the development noise level would be high when the developer flying control member 6 is mounted alone, the shielding effects achieved by the development-noise control member 7 can be obtained. This can reduce the sound pressure level of the development noise (AC noise). In this case, as can be seen from Expression (1), the rigidity of the sheet in itself tends to decrease. Therefore, a possibility of damaging the photosensitive drum 101 by the development-noise control member 7 is reduced.

It is useful that the third frequency $\alpha 3$, which is the natural frequency of the developer flying control member 6, lies between the first frequency $\alpha 1$ and the second frequency $\alpha 2$ of the AC bias. According to a further investigation conducted by the inventor et al., it is useful that the difference between a value of the third frequency $\alpha 3$ and the first frequency $\alpha 1$ or the second frequency $\alpha 2$ is about 200 to 300 Hz. This is because the results shown in FIG. 14 suggest that the third frequency $\alpha 3$ should be set in a range in which the sound pressure is stable.

When the fourth frequency $\alpha 4$, which is the natural frequency of the development-noise control member 7, is set so as to be smaller than the first frequency $\alpha 1$ of the AC bias and to be a value so that the difference between the fourth frequency $\alpha 4$ and the first frequency $\alpha 1$ is about 200 to 300 Hz, a good result can be obtained. This is because the results shown in FIG. 14 suggest that the fourth frequency $\alpha 4$ should be set in a range in which the sound pressure is stable.

Expression (1) represents the natural frequency for a cantilever. In the exemplary embodiment, both the developer flying control member 6 and the development-noise control member 7 are in contact with the photosensitive drum 101, so this is not a cantilever in a strict sense. However, since the developer flying control member 6 and the development-noise control member 7 are typically formed from a sheet that is so thin that their contact pressures are negligible, the natural frequencies can be approximated by Expression (1) alone.

According to the exemplary embodiment, although the developer flying control member 6 is vibrated by an AC electric field and thus produces AC noise during development, for any two frequencies, the AC noise can be significantly reduced by the development-noise control member 7. In other words, according to the exemplary embodiment, the frequency of the AC bias applied to the development roller 2 is switched between the first frequency $\alpha 1$ and the second frequency $\alpha 2$, which is higher than the first frequency $\alpha 1$. When the AC bias having either of the first frequency $\alpha 1$ or the second frequency $\alpha 2$ is applied to the development roller 2, the noise produced with the application of the AC bias can be effectively reduced. Therefore, according to the exemplary embodiment, in the case where the frequency of the AC bias applied to the development roller 2 lies in any frequency range between the first frequency $\alpha 1$ and the second frequency $\alpha 2$, the AC noise caused by oscillation of the AC electric field can be significantly reduced.

Other Exemplary Embodiments

In the first exemplary embodiment, the first frequency $\alpha 1$ or the second frequency $\alpha 2$ is selected as the frequency of the AC bias. However, the frequency of the AC bias can vary in multiple stages, as can be seen from FIG. 15. In this case, the sound pressure level of the AC noise can also be maintained low, as is the case with the above exemplary embodiment.

In the first exemplary embodiment, the end (second end) 62 of the developer flying control member 6 is in contact with the photosensitive drum 101. However, the end (second end) 62 of the developer flying control member 6 can be out of contact with both the development roller 2 and the photosensitive drum 101 within the developing area G. In this case, the AC noise can also be reduced by the development-noise control member 7. However, in the case where the end (second end) 62 of the developer flying control member 6 is in contact with the photosensitive drum 101, the end position is controlled easier.

In the first exemplary embodiment, the developer flying control member 6 is secured to the support metal plate 10 via the support base 8, and the development-noise control member 7 is secured to the support metal plate 10. However, the present invention is not limited to these securing. The developer flying control member 6 and the development-noise control member 7 can be mounted directly to the development frame (development container) or can be mounted to another member rigidly secured to the development frame (development container).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A developing device for developing an electrostatic image formed on an image carrier with a developer, the developing device comprising:

a frame;

a developer carrier configured to carry and convey the developer, the developer carrier facing the image carrier and developing the electrostatic image by causing the developer to fly from the developer carrier to the image carrier upon an application of an alternating-current bias to the developer carrier;

a developer flying regulation member including a first end disposed between the image carrier and the developer carrier and being configured to regulate an area where the developer flies; and a development-noise regulation member covering the developer flying regulation member, wherein noise produced by the development-noise regulation member vibrated by an oscillating electric field of the alternating-current bias is smaller than noise produced by the developer flying regulation member vibrated by the oscillating electric field, wherein the developer flying regulation member includes a second end mounted on the frame, the development-noise regulation member includes a third end mounted on the frame, and the developer flying regulation member is covered by the frame, the developer carrier, and the development-noise regulation member, wherein the development-noise regulation member includes a fourth end being in contact with the image carrier, and wherein a length of the fourth end of the development-noise regulation member is longer than a length of the first end of the developer flying regulation member in a direction transverse to a direction of movement of a surface of the image carrier.

2. The developing device according to claim 1, wherein the first end of the developer flying regulation member is disposed within a developing area between the image carrier and the developer carrier.

3. The developing device according to claim 1, wherein the alternating-current bias is a first frequency or a second frequency, and also when either one of the first frequency or the second frequency is applied to the developer carrier, noise produced by the development-noise regulation member vibrated by the oscillating electric field of the alternating-current bias is smaller than noise produced by the developer flying regulation member vibrated by the oscillating electric field.

4. A process cartridge comprising:

the deloping device according to claim 1; and the image carrier.

5. A developing device for developing an electrostatic image formed on an image carrier with a developer, the developing device comprising:

a developer carrier configured to carry and convey the developer, the developer carrier facing the image carrier and developing the electrostatic image by causing the developer to fly from the developer carrier to the image carrier upon an application of an alternating-current bias to the developer carrier;

a developer flying regulation member including a first end disposed between the image carrier and the developer carrier and being configured to regulate an area where the developer flies; and a development-noise regulation member covering the developer flying regulation member, wherein noise produced by the development-noise regulation member vibrated by an oscillating electric field of the alternating-current bias is smaller than noise produced by the developer flying regulation member vibrated by the oscillating electric field, wherein the developer flying regulation member includes a flexible sheet member, wherein the development-noise regulation member includes a flexible sheet member, and wherein a free length of the development-noise regulation member is larger than a free length of the developer flying regulation member.

6. The developing device according to claim 5, wherein the first end of the developer flying regulation member is disposed within a developing area between the image carrier and the developer carrier.

7. The developing device according to claim 5, wherein the alternating-current bias is a first frequency or a second frequency, and when either one of the first frequency or the second frequency is applied to the developer carrier, the noise produced by the development-noise regulation member vibrated by the oscillating electric field of the alternating-current bias is smaller than noise produced by the developer flying regulation member vibrated by the oscillating electric field.

8. A process cartridge comprising:

the developing device according to claim 5; and the image carrier.

9. A developing device for developing an electrostatic image formed on an image carrier with a developer, the developing device comprising:

a developer carrier configured to carry and convey the developer, the developer carrier facing the image carrier and developing the electrostatic image by causing the developer to fly from the developer carrier to the image carrier upon an application of an alternating-current bias to the developer carrier;

a developer flying regulation member including a first end disposed between the image carrier and the developer carrier and being configured to regulate an area where the developer flies; and a development-noise regulation member covering the developer flying regulation member, wherein noise produced by the development-noise regulation member vibrated by an oscillating electric field of the alternating-current bias is smaller than noise produced by the developer flying regulation member vibrated by the oscillating electric field, wherein a natural frequency of the development-noise regulation member is smaller than a natural frequency of the developer flying regulation member.

10. The developing device according to claim 9, wherein the first end of the developer flying regulation member is disposed within a developing area between the image carrier and the developer carrier.

11. The developing device according to claim 9, wherein the alternating-current bias is a first frequency or a second frequency, and also when either one of the first frequency or the second frequency is applied to the developer carrier, noise produced by the development-noise regulation member vibrated by the oscillating electric field of the alternating-current bias is smaller than noise produced by the developer flying regulation member vibrated by the oscillating electric field.

12. A process cartridge comprising:

the developing device according to claim 9; and the image carrier.

* * * * *